United States Patent [19]

Wendt

[11] 4,151,691

[45] May 1, 1979

[54] WALL PARTITION ASSEMBLY

[75] Inventor: Alan C. Wendt, Barrington, Ill.

[73] Assignee: United States Gypsum Company, Chicago, Ill.

[21] Appl. No.: 877,548

[22] Filed: Feb. 13, 1978

[51] Int. Cl.[2] ..... E04C 1/04

[52] U.S. Cl. ..... 52/242; 52/208; 52/395; 52/738; 52/730

[58] Field of Search ..... 52/238–242, 52/397–403, 456, 475, 208, 737, 738, 730–732, 395

[56] References Cited

U.S. PATENT DOCUMENTS

| | | | |
|---|---|---|---|
| 2,575,655 | 11/1951 | Clerk | 52/398 |
| 3,053,353 | 9/1962 | Miller | 52/456 |
| 3,081,849 | 3/1963 | Hubbard | 52/475 |
| 3,147,518 | 9/1964 | Horgan | 52/397 |
| 3,553,918 | 1/1971 | Dauson | 52/208 |
| 3,568,383 | 3/1971 | Judkins et al. | 52/242 |
| 3,848,387 | 11/1974 | Hafner | 52/738 |
| 3,868,804 | 3/1975 | Tantlinger | 52/731 |
| 3,978,629 | 9/1976 | Echols | 52/395 |

*Primary Examiner*—James L. Ridgill, Jr.

*Attorney, Agent, or Firm*—Glenn W. Ohlson; Robert H. Robinson; Samuel Kurlandsky

[57] ABSTRACT

A hollow wall partition assembly is disclosed which comprises a flanged ceiling rail, two opposing spaced apart rows of wall panels, snap-on trim pieces engaging grooves on the ceiling rail whereby the snap-on trim pieces conceal exposed unfinished portions of the ceiling rail. The partition assembly includes a snap-on glazing cover for window framing which is engageable with the assembled ceiling rail and snap-on trim pieces. A mullion and jamb attachment clip is provided for attaching door frame jambs and vertical mullions to the assembled ceiling rail and snap-on trim pieces.

15 Claims, 11 Drawing Figures

WALL PARTITION ASSEMBLY

BACKGROUND OF THE INVENTION (1) Field of the Invention

This invention relates to a hollow wall partition assembly which has a ceiling runner engageable with snap-on trim pieces and snap-on components.

(2) Description of the Prior Art

Present hollow wall partition assemblies utilize a flanged ceiling rail. These flanged rails provide channels for engagement with upper edges of wall panels. The ceiling rails therefore separate and support opposing rows of panels.

When assembled, present wall partition assemblies typically provide a decorative upper molding surface. This decorative surface is, in many systems, the exposed portions of the ceiling rail. Most commonly, aluminum ceiling rails are anodized such that a desirable esthetic effect is provided with these exposed portions.

An economic problem exists with the existing flanged ceiling rail. The cost of anodizing the entire aluminum rail is out of proportion to the amount of exposed surface area viewable when the assembly is installed. Concealed, or non-exposed, surfaces of flanges, top plates, and other portions of the ceiling rail are chargeable surfaces for anodizing costs because the entire surface area must be anodized. Since these surfaces are not seen when the partition assembly is in position, it would be desirable to avoid the additional costs.

Also, in using the anodized, or finished, flanged ceiling rail, additional time must be spent during installation because precision cutting and fitting at corners and joints is required. This portion of installation must be performed by skilled craftsmen. It would save time and reduce costs to provide a flanged rail that can be installed with its basic mill finish and be simply square cut and butted at tee intersections as well as merely roughly mitered with a hacksaw at corners.

When a wall partition assembly is utilized in areas where door frames, windows, and other openings are involved, the additional required job-site cutting and installation becomes a severe burden both from a standpoint of time and money. It would be particularly desirable to alleviate these problems.

OBJECTS OF THE INVENTION

Accordingly, it is the primary object of this invention to provide a hollow wall partition assembly that reduces finishing costs by utilizing a basic mill finished flanged rail and snap-on components concealing otherwise exposed portions of the flanged rail.

It is, therefore, an object of this invention to provide a system wherein only the trim components might require costly finishing, such as anodizing.

With more particularity, it is an aim of this invention to provide snap-on trim pieces engageable with outer surfaces of a flanged ceiling rail.

Additionally, it is an object of this invention to provide a snap-on mullion and jamb attachment clip engageable with a flanged ceiling rail at window and door openings in a hollow wall assembly.

Further, it is an allied object to provide a snap-on glazing cover for engagement with a glass panel and flanged ceiling rail at window openings in a hollow wall assembly.

A more detailed object of this invention is to provide a basic mill finished flanged aluminum ceiling rail that can be square cut and butted at tee intersections and roughly mitered with a hacksaw at corners thus allowing entire wall partition sections to be erected prior to the installation of snap-on trim components which require precision cutting and fitting.

SUMMARY OF THE INVENTION

In accordance with the invention, a hollow wall partition assembly is provided which comprises a flanged ceiling rail having two outer channels wherein two opposing spaced apart rows of wall panels are positioned within the outer channels. Oppositely facing snap-on trim members engage outwardly facing grooves along outer surfaces of the flanged ceiling rail to thereby conceal otherwise exposed unfinished portions of the rail.

A snap-on glazing cover is also provided in accordance with this invention. This glazing cover attaches to the assembled ceiling rail and snap-on trim members at window locations and supportively engages an edge of a glass panel.

A mullion and jamb attachment clip is provided pursuant to this invention which is usable for separately fastening door frame jambs and vertical mullions to the ceiling rail provided in the hollow wall partition assembly of this invention. The vertical mullion and door frame jamb attachment clip is engageable with both quadra-flanged and bi-flanged ceiling rail designs.

BRIEF DESCRIPTION OF THE DRAWINGS

Other objects and advantages of the present invention will become apparent upon reading the following detailed description and upon reference to the drawings, in which.

DESCRIPTION OF THE PREFERRED EMBODIMENTS

This invention may be more fully described, but is not limited, by reference to the attached drawings and following discussion of the preferred embodiments discussed hereinafter.

Figure 1:
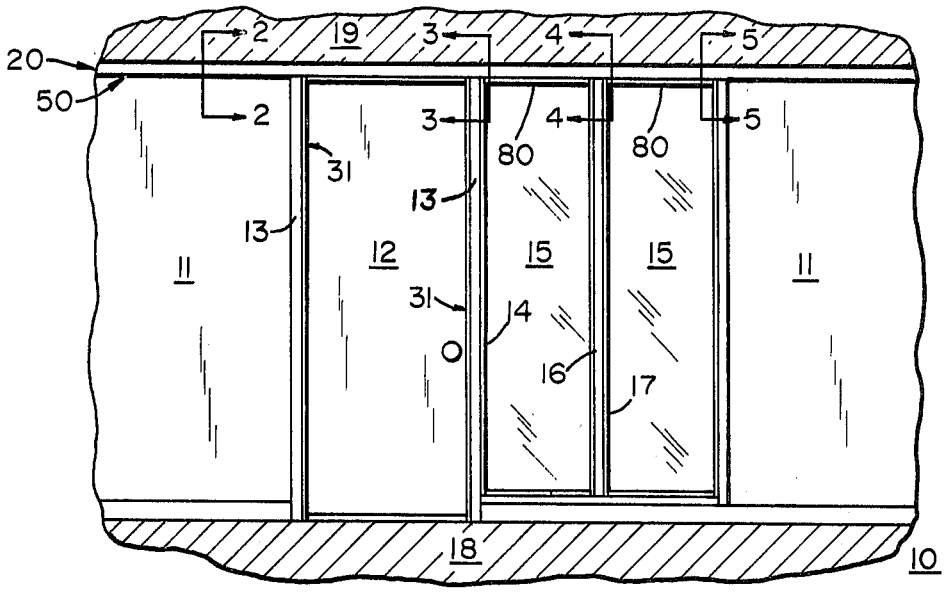
FIG. 1 is a partial elevational view of the hollow wall partition assembly illustrating one embodiment of the present invention.

Turning now to the drawings, FIG. 1 illustrates the preferred embodiment for this invention. A hollow wall partition assembly 10 is shown. Wall panels 11 are shown extending from a lower floor structure 18 up to a ceiling rail 20 which is supportably engaged to ceiling support structure 19. A snap-on trim member 50 conceals otherwise exposed portions of ceiling rail 20. Also provided in partition assembly 10 is door 12 having door jamb 13 which is a typical framing structure. Glass panels 15 are shown and are supported along their upper edge by a glazing cover 80. At the juncture of door jamb 13 and glass panel 15 a door jamb glazing cover 14 engages glass panel 15 and covers door jamb 13. At the juncture of both glass panels 15 a mullion 16 is provided having mullion cover 17 which engages a glass panel 15 and covers mullion 16.

The hollow wall partition assembly 10 shown in FIG. 1 comprises a preferred embodiment of this invention and the arrangement of the wall panels 11, door 12 and glass panels 15 is, of course, one arrangement out of numerous others in accordance with the invention.

Figure 2:
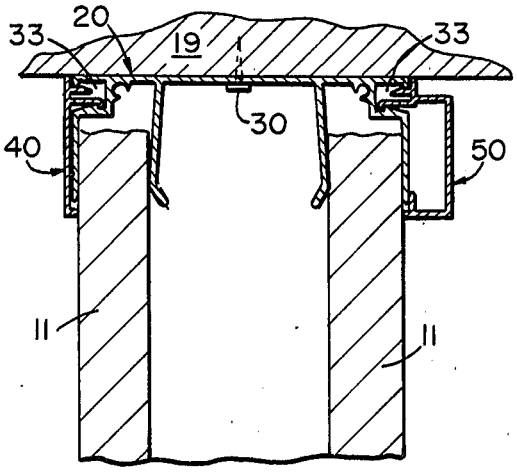
FIG. 2 is a sectional view taken along line 2—2 of FIG. 1 showing two spaced apart rows of wall panels and flanged ceiling rail assembly in accordance with this embodiment of the invention.

FIG. 2, is a cross-section of partition assembly 10 taken along line 2—2 of FIG. 1 in the direction of the arrows. It is seen that two wall panels 11 are provided in spaced apart rows. Wall panels 11 are engaged by ceiling rail 20 shown in the preferred embodiment to be quadra-flanged. Ceiling rail 20 is supportably engaged to upper ceiling support structure 19 by conventional means such as fastener 30. A flush snap-on trim member 40 engages ceiling rail 20 to conceal otherwise exposed unfinished portions thereof. Similarly, at the other side of ceiling rail 20, an offset snap-on trim member 50 engages ceiling rail 20. Grooves 33 are provided along ceiling rail 20 for snap-on engagement with snap-on trim members 40 and 50.

Figure 3:
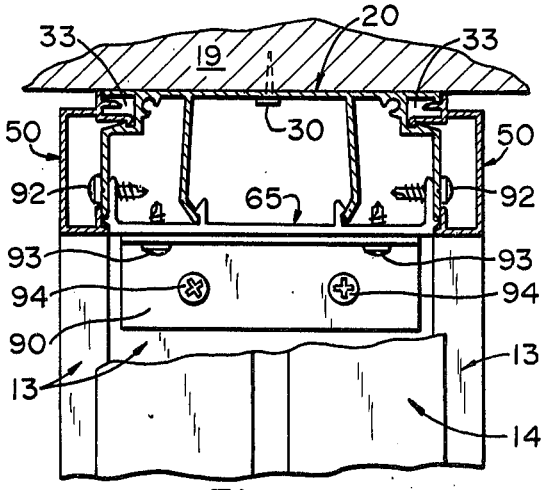
FIG. 3 is a sectional view taken along the line 3—3 of FIG. 1 showing the hollow wall partition assembly at a door frame jamb for this embodiment of the invention.

Referring now to FIG. 3, a cross-sectional view is depicted which is taken along line 3—3 of FIG. 1 looking in the direction of the arrows. This cross-sectional view illustrates the hollow wall partition assembly 10 of this invention at the juncture of a door jamb 13 and glass panel 15 residing in the window frame opening as shown. Door jamb glazing cover 14 engages door jamb 13 and provides engageable means for an edge of glass panel 15. The broken away portion of door jamb glazing cover 14 shows the connection of the door jamb 13 to ceiling rail 20. A mullion and jamb attachment clip 65 is secured to ceiling rail 20 by screw fastener means 92. A bracket 90 secures door jamb 13 to attachment clip 65. Bracket 90 is shown in this preferred embodiment to be generally L-shaped and has an upper portion of the L attached to attachment clip 65 by screw fastener means 93 penetrating therethrough. Screw fastener means 94 penetrate the other arm of the L comprising bracket 90 and secure door jamb 13 by penetrating a surface thereof.

As can be seen in FIG. 3, offset snap-on trim members 50 engage ceiling rail 20 by snap-on engagement with engageable grooves 33. In accordance with this invention, as best seen in FIGS. 1 and 3, attachment clip 65 is provided only along that portion of the ceiling rail 20 extending across door jamb glazing cover 14 and door jamb 13 at a door side 31 of door 12.

Figure 4:
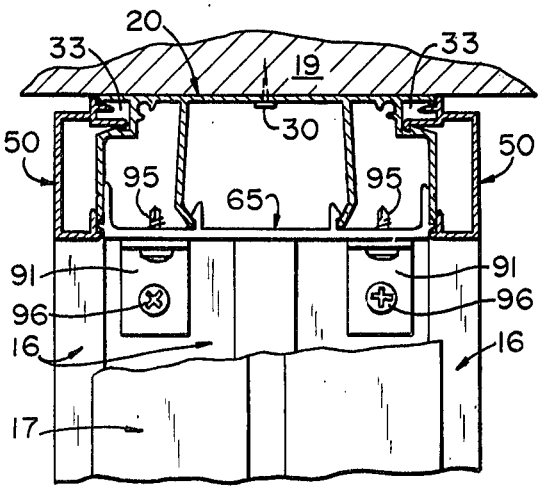
FIG. 4 is a sectional view taken along line 4—4 of FIG. 1, illustrating a mullion assembly for the hollow wall partition assembly in accordance with this embodiment of the invention.

FIG. 4 illustrates another cross-sectional view provided in this preferred embodiment of the invention. FIG. 4 is a cross-section taken along line 4—4 of FIG. 1 in the direction of the arrows. This cross-section is taken at the juncture of two glass panels 15 at mullion 16 and mullion cover 17 which engage vertical edges of glass panels 15 and are supported at upper ends by attachment clip 65 engaging ceiling rail 20. At mullion 16 bracket means 91 are shown to be the desirable connective devices between attachment clip 65 and mullion 16. Vertical screw fasteners 95 penetrate upper portions of bracket 91 and portions of attachment clip 65. Similarly to bracket 90 of FIG. 3, bracket 91 is preferably of an L-shape and a lower depending arm of the L is penetrated by screw fasteners 96 which secure mullion 16 by similar penetrating engagement.

Along ceiling rail 20, offset snap-on trim members 50 engage engageable grooves 33 and thereby conceal otherwise exposed portions of ceiling rail 20. No screw fastener means is necessary between attachment clip 65 and ceiling rail 20. Thus, screw fastener 92, shown in FIG. 3 for a door jamb attachment, is not required for a mullion attachment assembly. However, a fastener between attachment clip 65 and ceiling rail 20 would be useful if additional rigidity is desired. Again, in similar manner to a door jamb connection, attachment clip 65 extends only across ceiling rail 20 for the portion traversing the mullion 16 and mullion cover 17 connection area. Horizontally from either side of mullion 16 and mullion cover 17 a glazing cover 80 separately engages ceiling rail 20.

Figure 5:
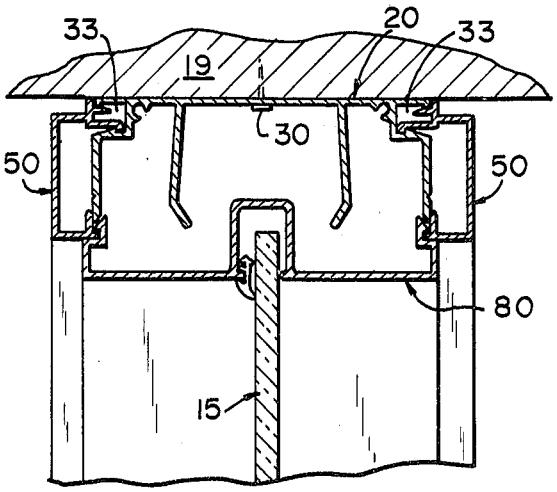
FIG. 5 is a sectional view taken along line 5—5 of FIG. 1, showing a glazing cover assembly for a hollow wall partition assembly in accordance with this embodiment of the invention.

As shown by FIG. 5, the alignment of glazing cover 80 is clearly depicted. FIG. 5 is a cross-sectional view taken along line 5—5 of FIG. 1 in the direction of the arrows. This Figure, in similar manner to FIGS. 4 and 5, shows the preferred embodiment of this invention wherein a ceiling rail 20 is secured by conventional fastener means 30 to an upper ceiling support structure 19. A glass panel 15 is supportably engaged along an upper edge by a glazing cover 80. Glazing cover 80 is supported by ceiling rail 20 in a snap-on engagement. Along outer sides, which would otherwise be exposed to view, offset snap-on trim members 50 snappingly engage engageable grooves 33 and ceiling rail 20 to thereby provide engageable snap-on surfaces for glazing cover 80.

Unlike the requirement of screw fastener means for a mullion 16 or a door jamb 13, glazing cover 80 requires only snap-on engagement with the assembled ceiling rail 20 and offset snap-on trim members 50. It is critical that the snap-on trim members 50 resist upward and outward forces, produced by the engagement with snap-on glazing cover 80, to thereby maintain supportive engagement for glass panel 15.

Figure 6:
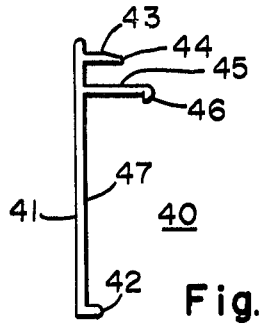
FIG. 6 is an end view of a flush fitting snap-on trim piece according to this invention.
Figure 7:
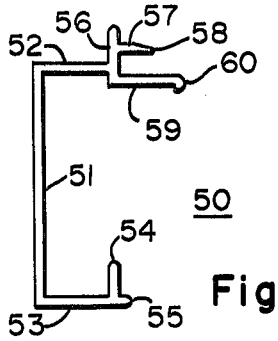
FIG. 7 is an end view illustrating an offset snap-on trim piece in accordance with this embodiment of the invention.
Figure 8:
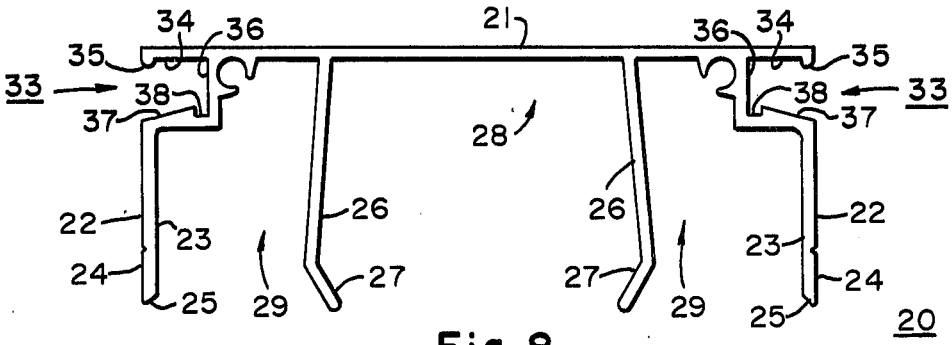
FIG. 8 is an end view of a quadra-flanged ceiling rail in accordance with the present invention.
Figure 9:
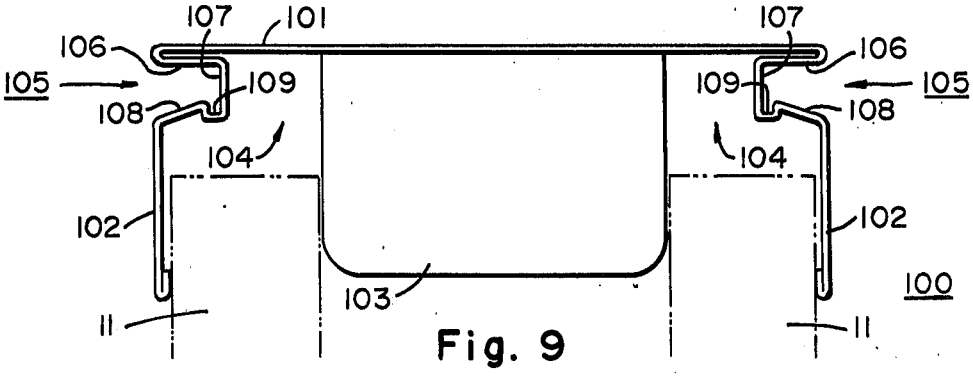
FIG. 9 is an end view illustrating a bi-flanged ceiling rail in accordance with this invention.
Figure 10:
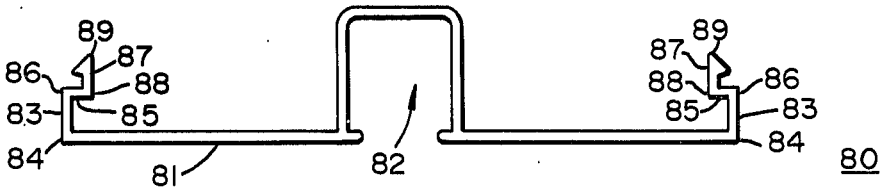
FIG. 10 is an end view of a glazing cover in accordance with this invention.
Figure 11:
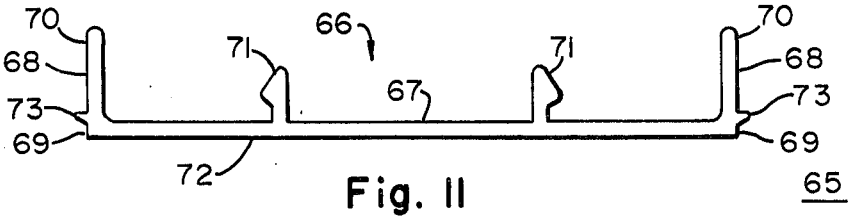
FIG. 11 is an end view of the attachment clip for attaching mullion or jamb members in accordance with this preferred embodiment of the invention.

In turning now to the Figures providing the specific structural conformations for the snap-on elements and other components of the hollow wall partition assembly of this invention, attention is directed to FIGS. 6–11. FIGS. 6 and 7 show the structures for the snap-on trim members 40 and 50. FIG. 8 depicts the quadra-flanged ceiling rail 20 of the preferred embodiment engageable with snap-on trim members 40 and 50. FIG. 9 illustrates another desirable embodiment for the structure of the ceiling rail and provides a bi-flanged ceiling rail 100 also engageable with snap-on trim members 40 and 50. FIG. 10 shows the glazing cover 80 in accordance with this invention for snap-on engagement with assembled ceiling rail and snap-on trim members to supportably engage glass panels at window locations and the like. In FIG. 11 attachment clip 65 is illustrated for the preferred embodiment of this invention. Both glazing cover 80 and attachment clip 65, FIGS. 10 and 11 respectively, are engageable with quadra-flanged ceiling rail 20 of FIG. 8 as well as the other desirable embodiment in FIG. 9 shown to be bi-flanged ceiling rail 100.

In FIG. 6, an end view of the preferred embodiment of flush snap-on trim member 40 is shown. This snap-on trim member comprises a body portion 41 having a lip portion 42 extending generally at right angles from a lower edge a distance of no less than the thickness of outer flange 22 of ceiling rail 20. At a distance no less than the thickness of top plate 21 of ceiling rail 20 from the edge of body portion 41 distal lip portion 42, a finger portion 43 extends at generally right angles. Finger portion 43 terminates in a bevelled tip 44. A leg member 45 extends from body portion 41 at a point intermediate lip portion 42 and finger portion 43 and in generally the same direction as they extend. Leg member 45 terminates in a bulb edge 46 which protrudes below leg member 45. Snap-on trim member 40 is denoted as being flush because, when assembled with ceiling rail 20, an inner side 47 of body portion 41 provides a substantially flush fitting surface with the outer sides of the outer flanges of the ceiling rail.

FIG. 7 shows the preferred embodiment for offset snap-on trim member 50. Its structural conformation differs from snap-on trim member 40 in that it provides a block C-shape with upper arm 52 and lower arm 53 extending from a body portion 51 thereby providing the offset of this member. Upper arm 52 and lower arm 53 extend generally at right angles from generally vertical back portion 51. An upward projection 54 extends from lower arm 53 at a point from free end 55 no less than the thickness of outer flange 22 of ceiling rail 20. Upward projection 54 extends upwardly a distance less than the height of vertical back portion 51. At the end of upper arm 52 opposite body portion 51, a flange member 56 is connected and extends above and below upper arm 52 at generally right angles thereto. A finger portion 57 extends from flange member 56 at a distance of no less than the thickness of top plate 21 of ceiling rail 20 from the edge of the flange member above the upper arm 52. Finger portion 57 extends at generally right angles from flange member 56 and terminates in a bevelled tip 58. From the edge of flange member 56, distal upper arm 52, extends leg member 59 projecting at generally right angles thereto. Leg member 59 terminates in a bulb edge 60 having a portion of the bulb projecting below the leg.

In the preferred embodiment, upward projection 54 and flange member 56 of offset snap-on trim member 50 reside in generally the same imaginary vertical plane. It is seen that the reference to snap-on trim member 50 as being offset refers to the lengths of upper arm 52 and lower arm 53 which position body portion 51 at a distance from this imaginary plane. In this regard, if the lengths of upper arm 52 and lower arm 53 were reduced to nothing, the conformation of snap-on trim member 50 would be identical to that of flush snap-on trim member 40.

Turning now to FIG. 8, quadra-flanged ceiling rail 20 is illustrated. From a top plate 21 depend outer flanges 22 having inward sides 23, outward sides 24, and lower ends 25. Intermediate outer flanges 22, inner flanges 26 also depend from top plate 21. In the preferred embodiment inner flanges 26 are skewed outward. Inner flanges 26 terminate at lower ends with inwardly skewed legs 27. The depending flanges thereby provide a central channel 28 between inner flanges 26, and two outer channels 29 between the opposing pairs of inner flanges 26 and outer flanges 22. As shown best in FIG. 2, wall panels 11 engageably reside within outer flanges 29.

In the preferred embodiment shown in FIG. 8, as well as the hollow wall partition assembly 10 of FIG. 1, ceiling rail 20 comprises unfinished extruded aluminum. The cost of anodizing a ceiling rail requires all the surface area of the rail be taken into account because it is not feasible to anodize specific portions thereof. Therefore, ceiling rail 20 is provided with engageable grooves 33. These engageable grooves allow both flush fitting snap-on trim members 40 and offset snap-on trim members 50 to engage ceiling rail 20. With this engagement, the portions of unfinished ceiling rail 20, which would be otherwise exposed to view, are concealed. In this preferred embodiment, engageable groove 33 is shown to comprise an upper surface 34 residing in a generally horizontal orientation. Upper surface 34 is shown to terminate with a bulb edge 35 at an edge opposite a generally right angle intersection with generally vertical back wall 36. Groove 33 has a bottom surface 37 which is inclined upwardly from outward side 24 of outer flange 22 to an inner side terminating at back wall 36 with a notched portion 38.

Engageable groove 33 of quadra-flanged ceiling rail 20 is snap-on engageable by snap-on trim member 40 and snap-on trim member 50. Notched portion 38 is receptive to snap-on engagement by either bulb edge 46 of flush fitting snap-on trim member 40 or bulb edge 60 of offset snap-on trim member 50. Bevelled edge 44 of snap-on trim member 40 wedges beneath bulb edge 35 of engageable groove 33 to provide additional snap-on engagement. Similarly, bevelled edge 58 of offset snap-on trim member 50 is engageable beneath bulb edge 35 to provide complementary snap-on, or wedge-like, engagement between trim member and groove. It is necessary that the assembled ceiling rail and snap-on trim members resist upward and outward forces which result during engagement and support of snap-on covers such as glazing cover 80. The structures shown in FIGS. 6 and 7 for snap-on engagement of either of the snap-on trim members 40 or 50 with ceiling rail 20 provide this resistance and support.

FIG. 9 depicts another embodiment for a ceiling rail in accordance with this invention. This other desirable embodiment is shown to be bi-flanged ceiling rail 100. Ceiling rail 100 comprises a top plate 101 having outer flanges 102 depending therefrom. Intermediate outer flanges 102, there is depending tab means 103 extending downwardly from top plate 101. Tab means 103, in this preferred embodiment of the invention, comprises a single tab at each of several spaced apart locations along bi-flanged ceiling rail 100.

Accordingly, it is seen in FIG. 9 that between tab means 103 and outer flanges 102 engageable channels 104 are thereby provided. In phantom, wall panels 11 reside within engageable channels 104 to thereby provide a hollow wall partition assembly in accordance with this invention. In like manner to ceiling rail 20, the outer flanges 102 are provided with engageable grooves 105, which are engageable with snap-on trim members 40 and 50. Engageable grooves 105 comprise a generally horizontal upper surface 106 terminating at an inward side at generally vertical back wall 107. An inclined bottom surface 108 terminates at an inner side at back wall 107 with notched portion 109. An additional wedging action, such as provided by bulb edge 35 of engageable groove 33, is not included in FIG. 9. In this embodiment it is optional, thus a bulb edge can be provided at the outer edge of upper surface 106. Flush fitting snap-on trim member 40 engages in snap-on manner by means of bulb edge 46 snapping into notched portion 109. In like manner, bulb edge 60 of offset snap-on trim member 50 engages in snap-on manner with notched portion 109. As with ceiling rail 20, either snap-on trim member may be utilized depending on the desirability of having an offset trim portion. It is to be noted that as depicted in FIGS. 3–5, offset snap-on trim member 50 is provided since the offset distance is sufficient to maintain a desirable esthetic effect of a continuous vertical planar surface between outer surfaces of door jambs, mullions and glazing covers upward to the ceiling.

Turning to FIG. 10, a glazing cover 80 is provided in keeping with the invention. It comprises a plate portion 81 residing in a general horizontal plane and having a centrally located trough portion 82. Trough portion 82 is of sufficient dimension to provide sufficient space for engaging an edge of a glass panel 15 therein. Flange portions 83 extend upwardly at generally right angles from opposite edges 84 of plate portion 81. Re-flanges 85 extend inwardly from upper edges 86 of flanges 83 to terminate at inward edges 88 with upward projections 87. Upward projections 87 terminate in barbed ends 89 which provide snap-on engageable edges engageable with assembled ceiling rail and snap-on trim members. The snap-on engagement of glazing cover 80 is best depicted in FIG. 5. Barbed ends 89 exert outward and upper forces upon engagement with the assembled snap-on trim members and ceiling rail. As mentioned above, these upward and outward forces are resisted by the snap-on engagement of either flush fitting snap-on trim member 40 or offset snap-on trim member 50 with ceiling rail 20 as shown.

The mullion and jamb attachment clip 65 provided in the preferred embodiment of this invention is illustrated in FIG. 11. It comprises a snap-on engageable upper side 66 and engageable planar bottom surface 72 which is engageable by screw fastener means. Engageable upper side 66 comprises a base plate 67 having legs 68 extending upwardly from opposing sides 69 thereof. Legs 68 have outer sides 70 which contact inward sides 23 of outer flanges 22 of ceiling rail 20 when assembled. Intermediate the legs 68 are barbed nodes 71 extending upwardly from base plate 67. Barbed nodes 71 are located in positional correspondence with inwardly skewed leg portions 27 of inner flanges 26 of ceiling rail 20. Upon assembly of the hollow wall partition in accordance with this invention barbed nodes 71 engage in snap-on manner with skewed legs 27, best shown in FIGS. 3 and 4. As depicted in FIG. 3, when attachment of door jambs 13 and door jamb glazing covers 14 are required, screw fastener means 92 are provided. This fastening by screw fasteners 92, in addition to the snap-on engagement of barbed nodes 71, is provided to augment support during impact from the slamming of the door. As indicated in FIG. 4, no screw fastener means are provided through legs 68 because the snap-on engagement provided by barbed nodes 71 is sufficient for mullion 16.

Continuing with FIG. 11, when attachment clip 65 is utilized in an embodiment of this invention utilizing a bi-flanged ceiling rail 100, then barbed nodes 71 afford no snap-on engagement and screw fastener means must be utilized to connect outer flanges 102 of ceiling rail 100 with legs 68. Planar bottom surface 72 is penetrable by screw fastener means which are typically self-drilling. As shown in FIG. 3, screw fastener means 93 secure upper portions of a conventional bracket 90. In similar manner, illustrated in FIG. 4, screw fastener means 95 connect bracket means 91 along upper portions thereof to attachment clip 65. In both FIGS. 3 and 4, the brackets also attach along lower portions to mullion 16 or door jamb 13. Attachment clip 65 therefore provides an attachable surface such that interconnecting bracket means 90 and 91 can securely attach mullion, jambs, covers and the like to the ceiling rail.

As shown in FIG. 11, attachment clip 65 may additionally be provided with positioning means denoted as lip protruberances 73. These lip protruberances preferably extend outwardly from legs 68 at a distance from the bottom surface 72 no greater than the thickness of the outer flanges 22 of ceiling rail 20. During installation, these lip protruberances prevent location of attachment clips 65 beyond desirable vertical relative positioning with the ceiling rail. As the attachment clip 65 is raised into engagement position with ceiling rail 20, protruberances 73 abut lower ends 25 of outer flanges 22 thereby preventing errant positioning above the intended point.

The figures illustrate the preferred embodiment for the hollow wall partition assembly in accordance with this invention. In the preferred embodiment, an extruded aluminum quadra-flanged ceiling rail 20 is provided. In another desirable embodiment, a bi-flanged ceiling rail 100 comprising steel is provided. With either rail, the snap-on trim pieces are engageable and conceal otherwise exposed unfinished portions of the rail to thereby avoid requiring costly anodizing, or finishing, of the entire rail surface. A snap-on engageable assembly is shown having snap-on trim pieces and ceiling rails which provide engageability for other components in the hollow wall partition assembly such as the described glazing covers, mullions covers, door jambs and door jamb covers. Thus the invention as disclosed by Applicant in his preferred embodiment provides a new and useful hollow wall partition assembly which avoids costs of finishing otherwise unseen portions of ceiling rails.

In the preferred embodiment, snap-on trim members 40 and 50 comprise extruded aluminum, however, the snap-on trim members may be plastic, wood, steel and other materials equally adaptable that can provide snap-on engagement with the ceiling rail.

In affording the utilization of unfinished ceiling rails, entire wall panel assemblies may be pre-erected. Rough cutting can be more easily done beforehand, leaving the fine cutting and mitering of only snap-on trim members to be done at the job site. Thus, not only is the finishing of the ceiling rail, and costs attendant thereto, eliminated, but installation time is also significantly lessened. While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for descriptive purposes and are not intended to limit the scope of the invention here described and shown.

Having fully described this new and unique invention, the following is claimed:

1. A hollow wall partition assembly comprising:
an extruded quadra-flanged ceiling rail having two outer flanges and two inner flanges depending from a top plate thereby forming a central channel and two outer channels;
two opposing spaced apart rows of wall panels positioned within the outer channels;
said outer flanges having outward facing sides and inward facing sides;
said outer flanges having outwardly opening engageable grooves along the outward facing sides at upper portions thereof; and,
oppositely facing snap-on trim members engaged with the outwardly opening grooves; thereby concealing otherwise exposed unfinished portions of the quadra-flanged ceiling rail.

2. A hollow wall partition assembly as in claim 1 wherein the extruded quadra-flanged ceiling rail is comprised of aluminum.

3. A hollow wall partition assembly as in claim 1 wherein the two inner flanges are outwardly skewed and terminate at lower ends with inwardly skewed leg portions.

4. A hollow wall partition assembly as in claim 1 wherein said engageable grooves comprise:
a generally horizontal upper surface terminating at the outward opening with an edge having a bulb end that protrudes below the upper surface;
a generally vertical backwall meeting the side of the upper surface opposite the bulb end at substantially right angles;
an inclined bottom surface sloping upward from the outward opening edge at the outward facing side of said outer flange and terminating at the back wall with a notched portion; and wherein the grooves extend longitudinal of the ceiling rail for substantially the full length of the ceiling rail.

5. A hollow wall partition assembly as in claim 1 wherein at least one trim piece has integral one piece construction and comprises:
a body portion;
a lip portion extending from one edge of said body portion at generally right angles therefrom;
a finger portion extending from said body portion at a distance of no less than the thickness of the top plate of the ceiling rail from the edge of the body portion distal from the lip portion, and said finger portion extending at generally right angles from the body portion in substantially the same direction as the lip portion extends, and said finger portion having a length greater than said lip portion and terminating in a bevelled tip; and
a leg member projecting generally at right angles from said body portion in substantially the same direction as the lip portion from a position intermediate the finger portion and lip portion, and terminating in a bulb edge having a portion of the bulb projecting below the leg member; thereby providing a snap-on trim piece that conceals otherwise exposed unfinished portions of the quadra-flanged ceiling rail.

6. A hollow wall partition assembly as in claim 1 wherein at least one trim piece member has integral one piece construction and comprises:
a generally block C-shaped body portion wherein upper and lower arms of the C extend generally at right angles from a generally vertical back portion;
an upward projection extending at right angles from the lower arm at a distance from an end of the arm distal from the back portion no less than the thickness of the outer flange of the ceiling rail and extending upwardly a distance less than the height of the back portion;
a flange member connected to an end of the upper arm distal from the back portion and extending above and below the upper arm at generally right angles thereto;
a finger portion extending from said flange member at a distance of no less than the thickness of the top plate of the ceiling rail from the edge of the flange member above the upper arm and said finger portion extending at generally right angles from the flange member pointing in substantially the same direction as the arms of the C-shaped body portion, and said finger portion terminating in a bevelled tip; and
a leg member projecting generally at right angles from the edge of the flange member below the upper arm of the C-shaped body portion in substantially the same direction as the finger portion, and terminating in a bulb edge having a portion of the bulb projecting below the leg member; thereby providing a snap-on trim piece that conceals otherwise exposed unfinished portions of the quadra-flanged ceiling rail.

7. A hollow wall partition and window frame assembly comprising:
a quadra-flanged ceiling rail having;
a top plate,
two outer and two inner flanges depending from the top plate thereby forming;
a central channel,
two outer channels,
said outer flanges having outwardly opening engageable grooves;
two opposing spaced apart rows of wall panels positioned within the outer channels;
oppositely facing snap-on trim members engaged with the outwardly opening engageable grooves to thereby cover otherwise exposed portions of the two outer flanges;
a window frame having;
a snap-on glazing cover communicating with and positioned below the ceiling rail and supportively engaged with the oppositely facing snap-on trim members;
a glass panel supportively engaged along an upper edge by the glazing cover, and
window frame means supportively engaging remaining edges of the glass panels; whereby the assembly provides snap-on trim pieces engaging a snap-on glazing cover which thereby conceal otherwise exposed unfinished portions of the quadra-flanged ceiling rail.

8. A hollow wall partition and window frame assembly as in claim 7 wherein said snap-on glazing cover is of one piece integral construction and comprises:
a generally horizontal plate portion;
a trough portion centrally located on said plate portion opening downwardly and having sufficient depth and width to receive an edge of a glass panel positioned therein;

flange portions extending upwardly from opposite edges of the plate portion at generally right angles;

re-flange portions horizontally extending inwardly in opposing directions from an upper edge of said flange portions, and projections extending upwardly from inward edges of the re-flanges and terminating in a barbed end providing means thereby for snap-on engagement with the snap-on trim pieces; whereby a glass panel edge resides within said trough portion of said glazing cover and said glazing cover and said snap-on trim pieces provide concealment for otherwise exposed unfinished portions of the quadra-flanged ceiling rail.

9. A mullion and jamb attachment clip usable for fastening door frame jambs and vertical mullions to a ceiling rail in a hollow wall partition assembly wherein the partition assembly comprises:

a quadra-flanged ceiling rail having;

a top plate, two outer and two inner flanges depending from the top plate to form;

a central channel, and two outer channels, said two outer flanges having outwardly opening engageable grooves, both outer flanges terminating in lower free ends;

both the inner flanges terminating in lower free ends having skewed leg portions;

two opposing spaced apart rows of wall panels opposingly positioned within the outer channels of the ceiling rail;

oppositely facing snap-on trim members engaged with the outwardly opening engageable grooves to thereby conceal otherwise exposed unfinished portions of the quadra-flange ceiling rail; wherein the attachment clip secures at least one vertical mullion or secures at least one door frame jamb to the ceiling rail wherein said attachment clip comprises:

an engageable upper side engaged with the ceiling rail and communicating with the snap-on trim pieces, wherein the engageable upper side comprises:

a base plate;

legs extending upwardly at generally right angles from opposing sides of the base plate and said legs communicating along outer sides thereof with inward sides of the outer flanges of the ceiling rail;

two barbed nodes projecting upwardly from the base plate intermediate the leg portions in positional correspondence with the skewed leg portions of the inner flanges of the ceiling rail and engaging in a snap-on manner with said skewed leg portions; and a generally planar bottom surface; wherein bracket means are attached to said bottom surface by fastener means and said bracket means interconnects a vertical mullion or door frame jamb to the bottom surface of the attachment clip.

10. A mullion and jamb attachment clip as in claim 9 wherein positioning means is provided at outer sides of the leg portions for determining the relative vertical positions between the attachment clip and ceiling rail, wherein said positioning means comprises: a lip protruberance extending outwardly at generally right angles from the outer sides of the leg portions at a point from the generally planar bottom surface no less than the thickness of the snap-on trim pieces, and extending outwardly a distance no greater than the thickness of the outer flanges of the ceiling rail, whereby during installation the lip protruberances butt against the free ends of the outer flanges of the ceiling rail and thereby determine the relative vertical positions of the attachment clip and ceiling rail.

11. A hollow wall partition assembly comprising:

a flanged ceiling rail having;

a top plate;

two outer flanges depending from the top plate;

said outer flanges having outward facing sides and inward facing sides;

said outer flanges having outwardly opening engageable grooves along the outward facing sides at upper portions thereof;

depending tab means depending from the top plate intermediate the outer flanges, and said tab means being located at spaced intervals along the ceiling rail;

said outer flanges and tab means forming two channels engageable with wall panels;

two opposing spaced apart rows of wall panels positioned within the engageable channels;

oppositely facing snap-on trim members engaged with the outwardly opening grooves; thereby concealing otherwise exposed unfinished portions of the flanged ceiling rail.

12. A hollow wall partition assembly as in claim 11 wherein the flanged ceiling rail is comprised of steel.

13. A hollow wall partition assembly as in claim 11 wherein said engageable grooves comprise:

a generally horizontal upper surface terminating at the outward opening with an edge having a bulb end that protrudes below the upper surface;

a generally vertical back wall meeting the side of the upper surface opposite the bulb end at substantially right angles;

an inclined bottom surface sloping upward from the outward opening edge at the outward facing side of said outer flange and terminating at the back wall with a notched portion; and wherein the grooves extend longitudinal of the ceiling rail for substantially the full length of the ceiling rail.

14. A hollow wall partition assembly as in claim 11 wherein at least one trim piece has integral one piece construction and comprises:

a body portion;

a lip portion extending from one edge of said body portion at generally right angles therefrom;

a finger portion extending from said body portion at a distance of no less than the thickness of the top plate of the ceiling rail from the edge of the body portion distal from the lip portion, and said finger portion extending at generally right angles from the body portion in substantially the same direction as the lip portion extends, and said finger portion having a length greater than said lip portion and terminating in a bevelled tip; and a leg member projecting generally at right angles from said body portion in substantially the same direction as the lip portion from a position intermediate the finger portion and lip portion, and terminating in a bulb edge having a portion of the bulb projecting below the leg member; thereby providing a snap-on trim piece that conceals otherwise exposed unfinished portioons of the flanged ceiling rail.

15. A hollow wall partition assembly as in claim 12 wherein at least one trim piece member has integral one piece construction and comprises:

a generally block C-shaped body portion wherein upper and lower arms of the C extend generally at right angles from a generally vertical back portion;

an upward projection extending at right angles from the lower arm at a distance from an end of the arm distal from the back portion no less than the thickness of the outer flange of the ceiling rail and extending upwardly a distance less than the height of the back portion;

a flange member connected to an end of the upper arm distal from the back portion and extending above and below the upper arm at generally right angles thereto;

a finger portion extending from said flange member at a distance of no less than the thickness of the top plate of the ceiling rail from the edge of the flange member above the upper arm and said finger portion extending at generally right angles from the flange member pointing in substantially the same direction as the arms of the C-shaped body portion, and said finger portion terminating in a bevelled tip; and a leg member projecting generally at right angles from the edge of the flange member below the upper arm of the C-shaped body portion in substantially the same direction as the finger portion, and terminating in a bulb edge having a portion of the bulb projecting below the leg member; thereby providing a snap-on trim piece that conceals otherwise exposed unfinished portions of the flanged ceiling rail.

* * * * *